US006887410B2

(12) United States Patent
Kress et al.

(10) Patent No.: US 6,887,410 B2
(45) Date of Patent: May 3, 2005

(54) PARALLEL SPINNING PROCESS INVOLVING THE INTERMINGLING OF THREADS BETWEEN GALETTES AND A CORRESPONDING SPINNING INSTALLATION THEREFOR

(75) Inventors: Michael Kress, Alzenau (DE); Thomas Gries, Frankfurt am Main (DE)

(73) Assignee: Zimmer Aktiengesellschaft, Frankfurt am Main (DE)

( * ) Notice: Subject to any disclaimer, the term of this patent is extended or adjusted under 35 U.S.C. 154(b) by 326 days.

(21) Appl. No.: 10/203,262

(22) PCT Filed: Feb. 8, 2001

(86) PCT No.: PCT/EP01/01347

§ 371 (c)(1),
(2), (4) Date: Sep. 12, 2002

(87) PCT Pub. No.: WO01/59190

PCT Pub. Date: Aug. 16, 2001

(65) Prior Publication Data

US 2003/0074774 A1 Apr. 24, 2003

(30) Foreign Application Priority Data

Feb. 11, 2000 (DE) ..... 100 06 196

(51) Int. Cl.[7] ..... B65H 54/02; B65H 59/12; D01D 5/12; D02G 1/20; D02J 1/22

(52) U.S. Cl. ..... 264/103; 28/220; 28/240; 28/258; 28/290; 242/154; 242/416; 242/470; 264/210.8; 264/211.12; 425/66; 425/377; 425/382.2; 425/404

(58) Field of Search ..... 264/103, 210.8, 264/211.12; 425/66, 377, 382.2, 404; 28/220, 240, 258, 290; 242/154, 416, 470

(56) References Cited

U.S. PATENT DOCUMENTS

| | | | | |
|---|---|---|---|---|
| 3,577,615 A | | 5/1971 | LeNoir | |
| 3,902,833 A | | 9/1975 | Matovinovic | |
| 5,343,601 A | | 9/1994 | Schippers | |
| 5,794,868 A | | 8/1998 | Busenhart et al. | |
| 5,928,579 A | * | 7/1999 | Spahlinger et al. | 264/103 X |

FOREIGN PATENT DOCUMENTS

| | | |
|---|---|---|
| DE | 293 328 A5 | 8/1991 |
| DE | 41 30 059 A1 | 3/1993 |
| EP | 0 539 866 B1 | 1/1999 |
| JP | 56068 103 A | 6/1981 |
| WO | WO 96/09425 A1 | 3/1996 |

* cited by examiner

*Primary Examiner*—Leo B. Tentoni
(74) *Attorney, Agent, or Firm*—Norris McLaughlin & Marcus PA

(57) ABSTRACT

A parallel spinning process, in particular for filaments, e.g. for textile or industrial applications, made from polymers such as, for example, PET or PA, in each case having a thread interlacing device between two godets for each individual thread, the godets being moved in relation to one another during the piercing or feeding operation in such a way that each individual thread is automatically threaded into its interlacing device associated therewith, and the angle of wrap in the operating mode is at least from 85° to at most 200°, preferably from 175° to 185°.

8 Claims, 5 Drawing Sheets

PARALLEL SPINNING PROCESS INVOLVING THE INTERMINGLING OF THREADS BETWEEN GALETTES AND A CORRESPONDING SPINNING INSTALLATION THEREFOR

This application is a 371 of PCT/EP01/01347, filed Feb. 8, 2001.

BACKGROUND OF THE INVENTION

The invention relates to a parallel spinning process and to spinning machines equipped therewith, in particular for filaments, e.g. for textile or industrial applications, made from polymers such as polyester or polyamide, in each case having a thread interlacing device between two godets.

Spinning machines for conventional POY (partially oriented yarn) spinning processes are usually equipped with two separately driven, speed-regulated godets over which a plurality of threads (four, six or eight, depending on the winder) are guided in an S-shaped threadline in order to regulate the thread tension between the thread lubrication point and the take-up device. In this threadline, the freshly spun sheets of filaments are first guided in a parallel manner next to one another to the corresponding thread lubricating devices and are each combined there to give a cohesive thread, and then the threads are guided, grouped closely next to one another, over the aforesaid godets. The thread sheet is then fed to the winder, opened out again and turned through 90° to correspond to the desired bobbin width. In order to achieve better cohesion of the thread, pneumatically operated devices for tangling the threads, so-called tangle jets or interlacers, are frequently used. This is advantageously carried out between the godets: on the one hand, the thread tension can still be regulated, and on the other hand it is easier to insert the thread through the narrow thread gap.

In contrast to this crossed threadline (the extrusion axis is turned through 90° with respect to the winder axis), no simple solution or in fact no solution at all has been found for the arrangement of interlacers and handling between the godets in the parallel spinning process, such as in U.S. Pat. No. 3,902,853.

More modern parallel spinning processes have hitherto mainly been designed as SHSS (super-high-speed spinning, Lurgi Zimmer) or HOY (high oriented yarn) processes, in which the line runs directly, i.e. without godets, to regulate the thread tension, in a parallel and perpendicular manner out of the spinnerets to the winder. This low-cost, compact design is not entirely advantageous, however: as well as the process engineering disadvantages regarding the uniformity of the threads, the bobbin building and the limited range of titres, the threading in and feeding at the start of the spinning process in these space-saving types of short spinning machines is very time-consuming and highly inconvenient.

For POY spinning processes, parallel spinning machines have hitherto usually been equipped with two very expensive long godets, such as, for example, according to WO 96/09425, between which the tangle jets are accommodated. Here too, the threading-in and feeding is tedious and inconvenient, and moreover the feeding requires a certain amount of space simply for reasons of safety.

A further POY spinning process in which a small pair of godets is provided for each thread was presented in Paris by Barmag at the ITMA in June 1999. In this design, interlacers cannot be accommodated between the small godets. Although this solution is substantially less expensive than the long godet version, the fact that the function of regulating the thread tension is insufficiently fulfilled in this arrangement with small godets, given the small angle of wrap of less than 90°, means, however, that separate drives and speed regulation are logically omitted. Thus, there are considerable process-related disadvantages to counter the low investment costs: an inadequate angle of wrap, no regulation of the speed or thread tension, a lack of entangling between the godets and a considerable space requirement when setting up the machine for the time-consuming threading-in and feeding.

Thus, for POY spinning processes in parallel spinning machines, the object is to find a device for regulating the thread tension and for thread interlacing which is easy to operate and has better performance.

According to the invention, this object is achieved by the process and the device according to the claims.

In the arrangement of godets and interlacers according to the invention, the object is achieved at the same time as surprisingly operator-friendly handling and complete fulfillment of the desired functions. The new concept provides major process and handling advantages which mean that the higher investment quickly pays for itself over the operating time: a very large angle of wrap of more than 180° is achievable, as is thread interlacing between the godets and the use of speed-regulated drives to control the thread tension. Furthermore, the automatic threading into the tangle jets and over the godets, which is a surprising solution for handling, improves the effectiveness of the machines as a result of shorter feeding times.

SUMMARY OF THE INVENTION

In the proposed arrangement according to the invention, two godets (2; 3) are used for each thread (1) in such a way that in the operating state of the machine an angle of wrap of from at least 85° to a maximum of 200°, but preferably from 175° to 185°, is formed by each thread (1) at the godets (2; 3). The godets (2) are referred to in the description below as "lower" godets and the godets (3) are referred to as "upper" godets.

DETAILED DESCRIPTION

During the feeding phase, all the upper godets (3), which are combined on a movable godet unit (4) and are also driven jointly, are then moved downwards so that each individual thread (1) firstly coming from the upper thread guide (5) can be inserted, while being bent slightly at the lower godet (2), into the associated thread guide of the triangular traversing unit (6) (cf. FIG. 1). Once this has been carried out for all the threads (1), the godet unit (4), together with the upper godets (3), is moved upwards along a curved or preferably arcuate path (7) in order to avoid collision with the lower godets (2), and at the same time each individual thread (1) is threaded into the associated interlacer (8) (cf. FIG. 3).

In the end position for the operating state (cf. FIG. 3), an S-shaped threadline is formed for each thread, with in each case an angle of wrap of the godets (2; 3) of greater than 180° and with the interlacers (8) arranged between the godets (2; 3), which makes it possible to regulate the thread tension without difficulty. The lower godets (2) and the upper godets (3) are in each case combined in drive terms. This configuration of the godets (2; 3) in groups facilitates low-cost drives via toothed belts (9; 12) to provide low-cost driving and control means via electronic speed control. The entire arrangement here is accommodated in a housing (10) having a sliding door (11), which is only opened for feeding, so enabling excess processing aid blown off the thread (1) during tangling to be removed by simple suction.

In a further embodiment of the invention, the intention is to simplify the threading-in operation further by moving the traversing thread guides (6)—combined in a horizontally movable thread guide unit (not illustrated)—in such a way that each individual thread (1) is firstly threaded in, in each case precisely perpendicularly, and then all the threads (1) are drawn together in such a way that the first contact with the lower godets (2) takes place simultaneously for all the threads (1). The operation thereafter is as already described above: the upper godets (3) are moved upwards and threading into the respective interlacers (8) is carried out automatically. This is done by pivoting the individual upper godets (3), which are combined in groups in the godet unit (4), by means of a parallel pivot gear mechanism (14), preferably consisting of at least two pivot levers (15) and a pneumatic drive, along a curved path (7), this curved path (7) preferably corresponding to an arc (cf. FIGS. 1 to 4).

BRIEF DESCRIPTION OF THE DRAWINGS

The description below will be made with reference to illustrative drawings:

FIG. 1 shows the upper godets (3) moved downwards in the feeding mode, still below the lower godets (2), which sit immovably on the spinning face (13). The entire arrangement of the godets (2; 3) here is accommodated in a housing (10) having a sliding door (11) which is opened for feeding. In the feeding mode illustrated here, each individual thread (1), coming firstly from the upper thread guide (5), is bent slightly past the lower godet (2) and inserted into the associated thread guide of the triangular traversing unit (6) without touching the upper godets (3) or the intermingling device (8) in the process.

FIG. 2 shows a plan view onto the belt drives in the feeding mode with the threadline indicated. The upper godets (3), here indicated merely by a dashed line, are all combined on a pivotable godet unit (4) and have been pivoted downwards by means of a parallel pivot gear mechanism (14) consisting of two pivot levers (15) and a pneumatic drive (not illustrated here) along a curved path (7) corresponding to an arc. The upper godets (3) and the lower godets (2) are in each case combined into groups and are in each case driven jointly via a toothed belt (9, top, or 12, bottom). The comb-shaped belt paths over the numerous deflector rollers (17) are necessary to prevent the drives from colliding with one another.

FIG. 3 then shows a plan view onto the godets and the threadline in the operating mode, with angles of wrap of greater than 180°. Once all the threads (1) have been threaded in, according to the description referring to FIG. 1, the godet unit (4) (not illustrated here), together with the upper godets (3), is moved upwards along a curved or arcuate path (7) in order to avoid colliding with the lower godets (2), and at the same time each individual thread (1) is threaded into the associated interlacer (8), as drawn in the end position illustrated. The sliding door (11) can then be slid in front of the housing (10).

FIG. 5 shows, for a general view, a section through an illustrative parallel spinning facility in a back-to-back arrangement with two winders (16);

Figure 1:
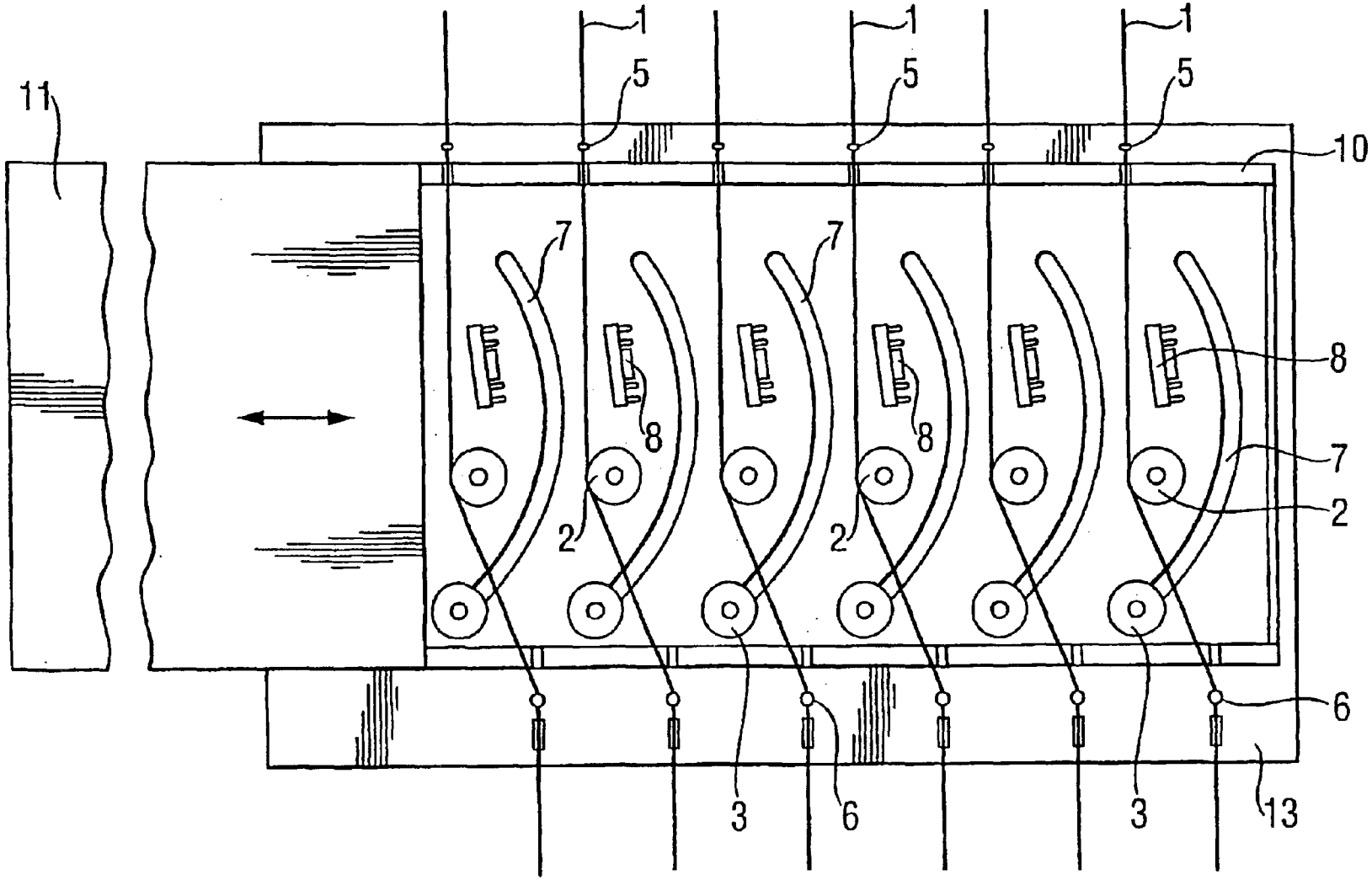
FIG. 1 shows the threadline, in plan view onto the godets, in the feeding mode.
Figure 2:
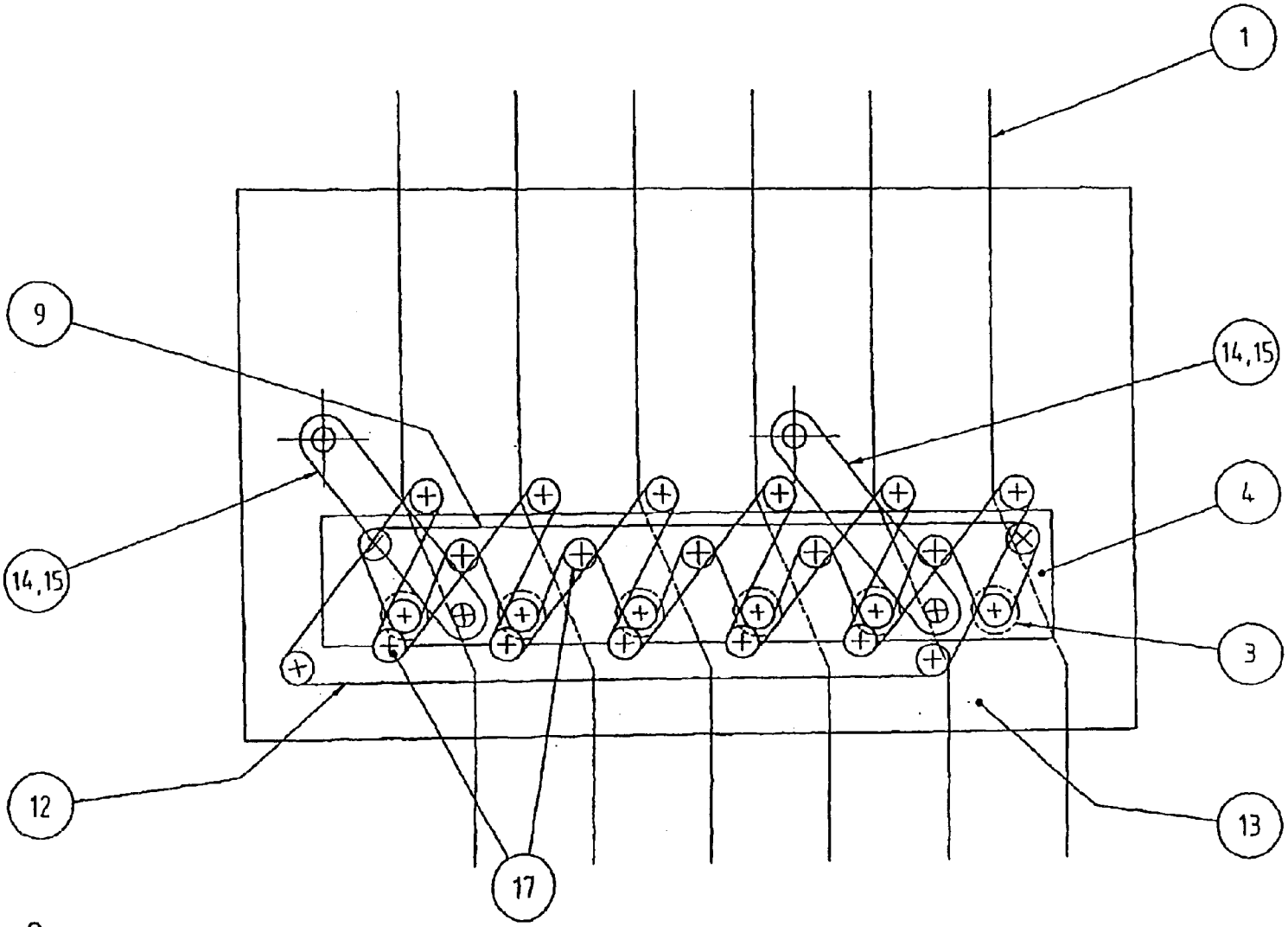
FIG. 2 shows a plan view onto belt drives in the feeding mode with the threadline.
Figure 3:
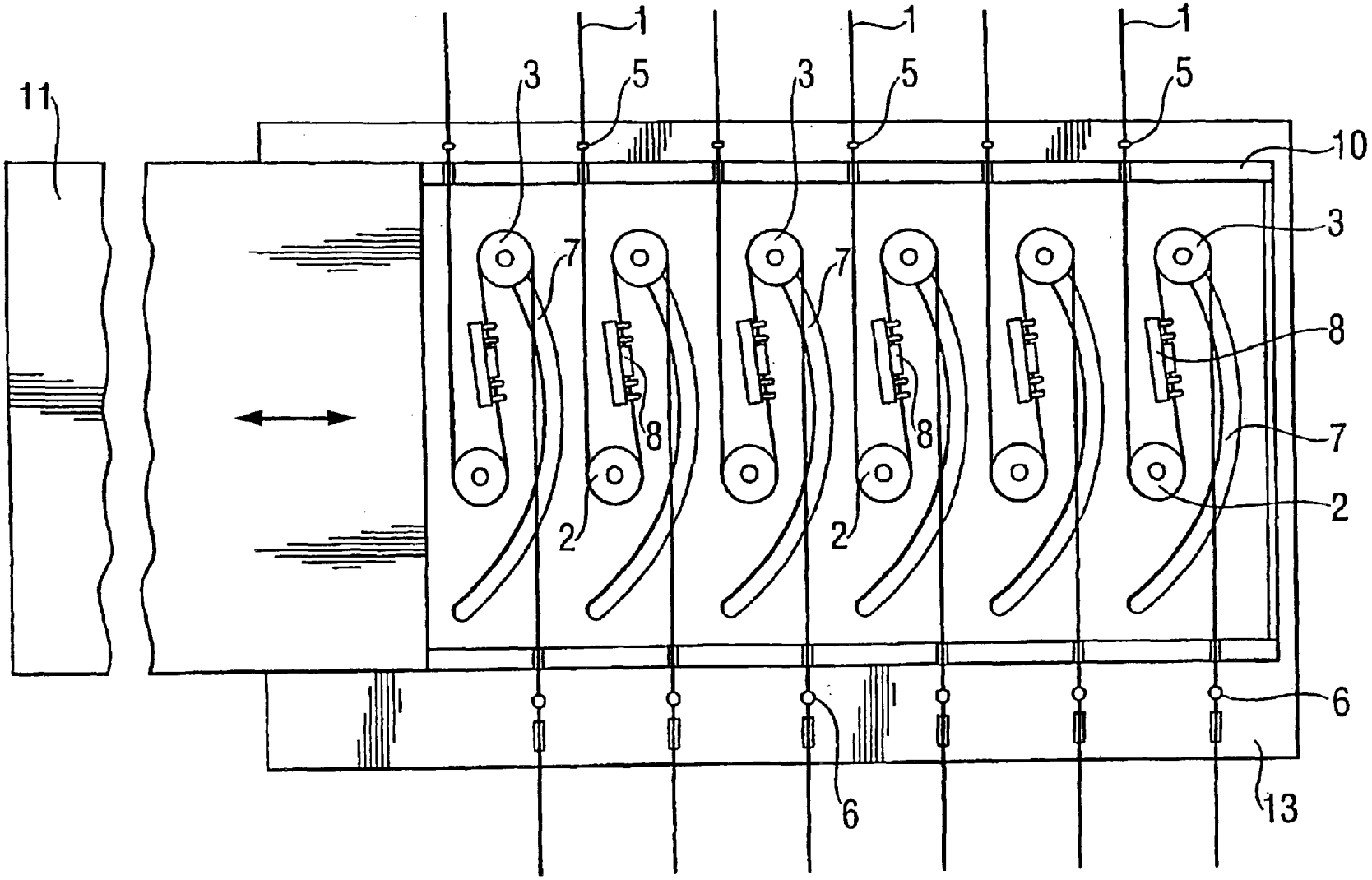
FIG. 3 shows the threadline, in plan view onto the godets, in the operating mode, FIG. 4 also shows the plan view onto the godets and belt drives in the operating mode.
Figure 4:
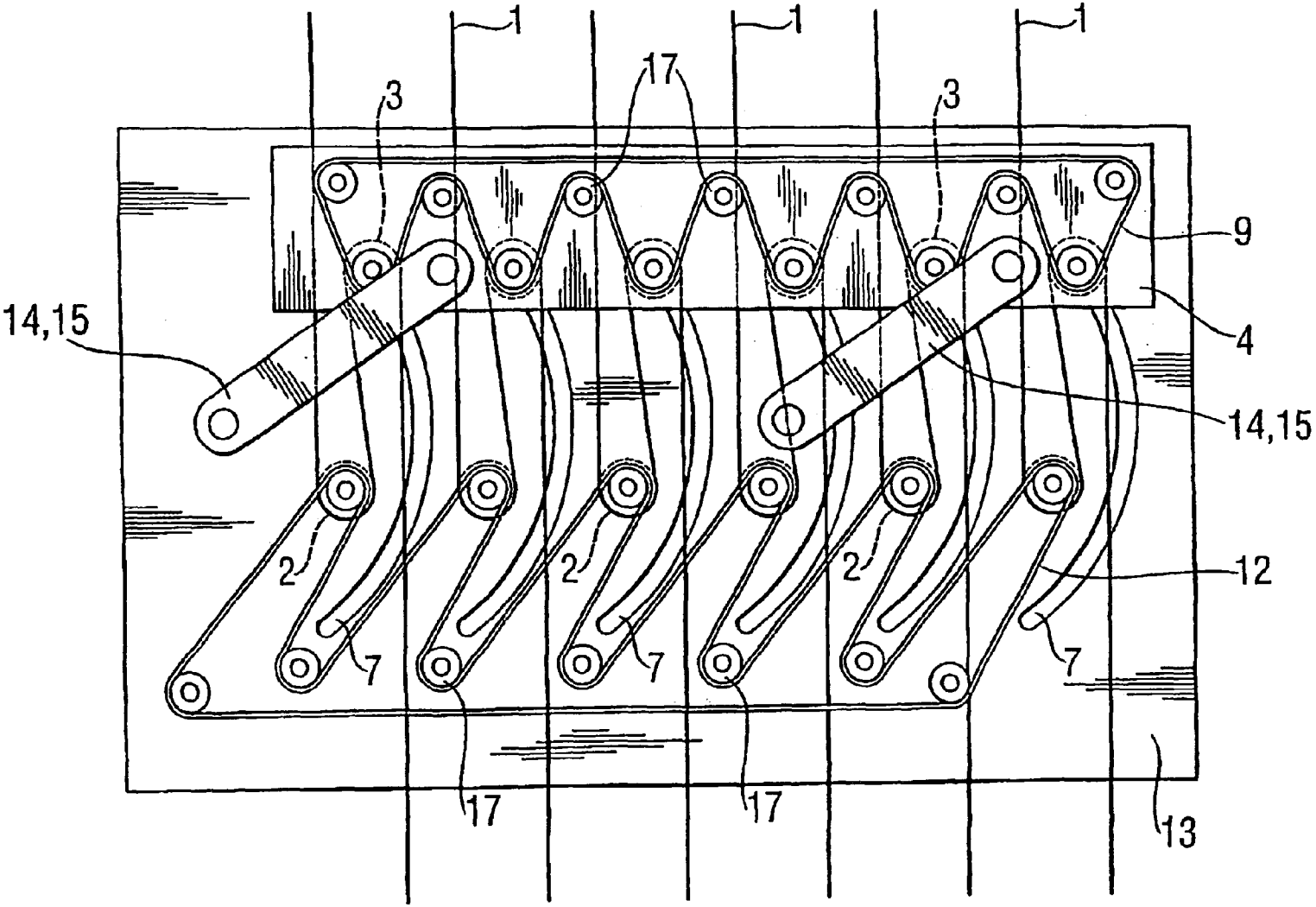
FIG. 4 again shows a plan view onto the belt drives, this time in the operating mode. The illustration is shown with the threadline indicated. The upper godets (3) have all been pivoted upwards on their pivotable godet unit (4) by means of the parallel pivot gear mechanism (14), consisting of two pivot levers (15) and a pneumatic drive (not illustrated), along a curved path (7). The two toothed belts (9, top, or 12, bottom) for the two groups of godets and the belt path over the deflector rollers (17) can be seen more clearly here.
Figure 5:
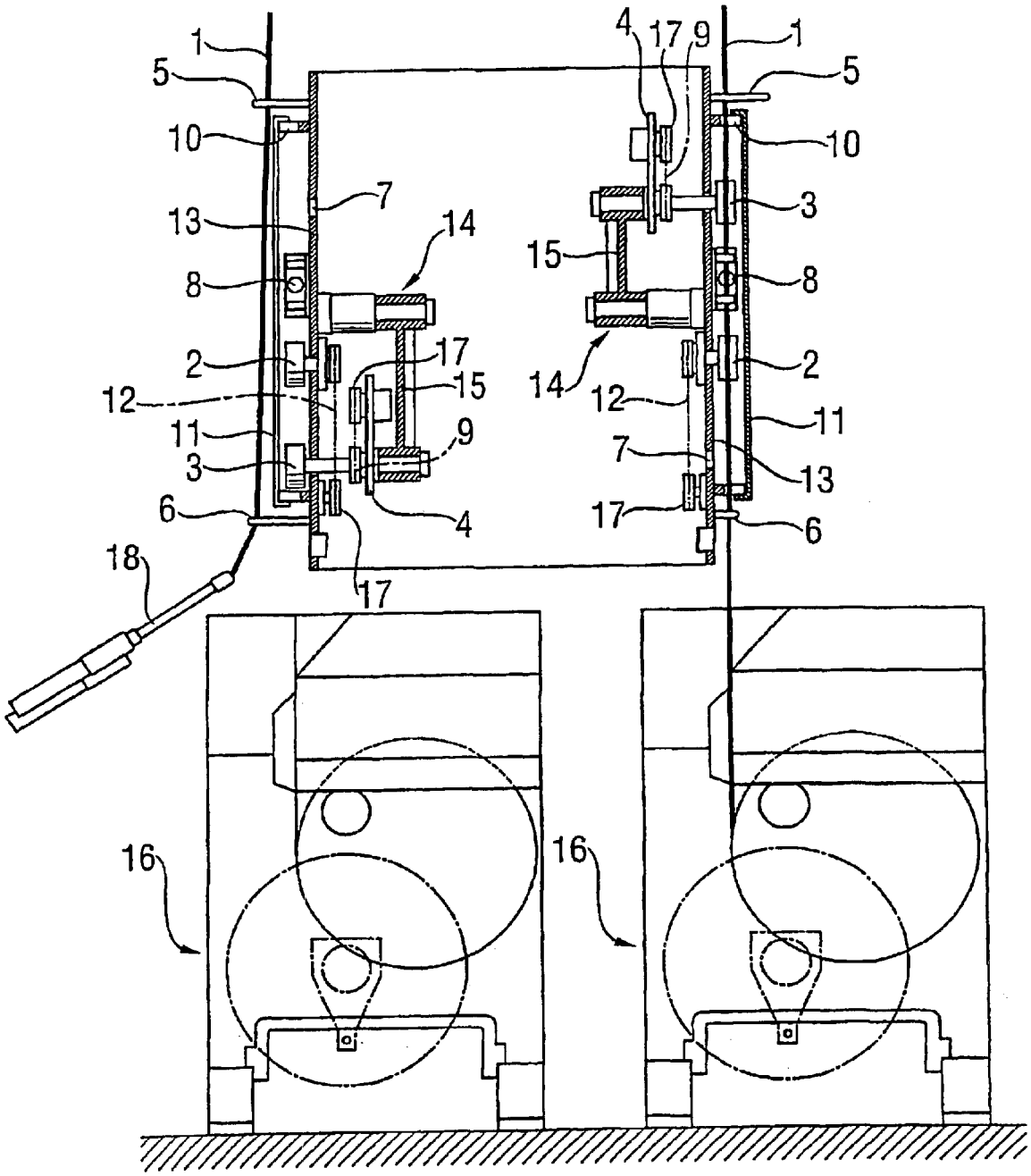
FIG. 5 shows a section through an illustrative parallel spinning facility in a back-to-back arrangement.

On the left in the drawing, the situation at the time of feeding is shown: the thread (1), coming from the upper thread guide (5), is inserted into the thread guide of the triangular traversing unit (6) by means of a feed gun (18). The godet unit (4), together with the upper godets (3), has been pivoted downwards in advance by means of the parallel pivot gear mechanism (14) consisting of two pivot levers (15). The arrangement of the godet unit (4), spatially offset with respect to the spinning face (13), is clearly visible, while the godets (2; 3) themselves all lie in the thread plane.

On the right, the operating mode is illustrated: the thread (1), coming from the upper thread guide (5), runs in a plane over the godets (2; 3) into the thread guide of the triangular traversing unit (6) to the winder (16). The godet unit (4) here has been pivoted upwards.

LIST OF REFERENCES

1. Thread
2. Lower godet
3. Upper godet
4. Movable godet unit
5. Upper thread guide
6. Thread guide of the triangular traversing unit
7. Curved or arcuate path
8. Interlacer; thread interlacing device; tangle jet
9. Toothed belt, top
10. Housing
11. Sliding door
12. Toothed belt, bottom
13. Spinning face; mounting unit for the lower godets
14. Parallel pivot gear mechanism
15. Pivot lever
16. Winder
17. Deflector rollers
18. Feeding gun

What is claimed is:

1. Parallel spinning process for the production or threads (1) which are to be wound up on winders (16), and are formed from grouped filaments produced by spinning polymer melts, and are drawn off over pairs of godets, which pairs comprise a second godet (2) and an first godet (3) having rotatable thread-guiding outer surfaces, the first godets (3) being combined on a movable godet unit (4), driven independently of the second godets and regulated independently of the second godets with respect of their speed for the purpose of adjusting the thread tension, and, in the operating state, each individual thread runs through a thread interlacing device (8), which is located between an associated pair of godets, wherein each individual thread (1) bears against the second godet (2) and first godet (3) of a from 175 to 185° pair of godets with an angle of wrap of from 175 to 185°.

2. Parallel spinning process according to claim 1, wherein, in a feeding phase prior to the operating state, the first godets (3), which are combined in the movable godet unit (4), are positioned in a first position spaced apart from the second godets (2) with the second godets (2) being between the first godets (3) and the associated thread interlacing devices (8) individual threads (1) are supplied through thread inlet guides (5) and guided between the associated first and second godets while being bent slightly, then inserted into a thread discharge guide of a traversing unit (6), and, in order to achieve the operating state, the movable godet unit (4) which comprises the first godets is pivoted to position the first godets spaced apart from the associated thread interlacing devices (8) with the thread interlacing devices (8) being between the first godets (3) and the second godets (2).

3. Parallel spinning process according to claim 2, wherein, during pivoting of the godet unit (4) which comprises the first godets (3) into the operating state, each individual thread (1) is automatically threaded into and through the thread interlacing device (8) associated with the pair of godets to which the first godet (3) over which it passes belongs to.

4. Parallel spinning process according to claim 1, wherein, in the operating state, each individual thread (1) first runs over a second godet (2), then through the thread interlacing device (8) associated with said second godet (2), and subsequently over the first godet (3) associated with said second godet (2).

5. A parallel spinning machine for the production of threads which are to be wound up on winders and are formed from grouped filaments produced by spinning polymer melts, comprising a plurality of thread supply guides (6), a plurality of thread discharge guides on a traversing unit (6), a plurality of pairs of godets, said pairs each comprising a first godet (3) and a second godet (2), having thread-guiding outer surfaces, said first godets being adapted to be driven independently of said second godets and regulated independently of the second godets with respect to their speed, with a thread interlacing device (8) associated with each pair of godets, said first godets (3) being arranged on a movable godet unit (4) adapted to be pivoted along a curved path to position said first godets (3) alternatively to a first position or a second position, said first position being spaced apart from said second godets with said second godets being between said first godets and said thread interlacing devices (8) and said second position being spaced apart from said thread interlacing devices with said thread interlacing devices being between said first godets and said second godets, said first godets being disposed to engage a thread running from said thread supply guides to said thread discharge guides and passing between said first godets and their associated second godets as said upper godets are moved by said movable godet unit (4) from said first position to said second position and move said thread into engagement with the interlacing devices associated with said godets.

6. Parallel spinning machine according to claim 5, wherein bearing and drive units for the godet unit (4) which comprises the first godets (3) and bearing and drive units for the second godets (2) are arranged in groups offset from one another on a spinning face (13) serving as a mounting unit, and all godets lie in the thread plane.

7. Parallel spinning machine according to claim 5, wherein the thread guides of the traversing unit (6) are combined in a single mounting unit and are movable.

8. Parallel spinning machine according to claim 5, comprising at least one pair of winders (16), each of which is associated with one godet unit which comprises upper godets (3), one spinning face (13) and one parallel pivot gear mechanism (14) with the godet units for each winder of said pair being positioned as mirror image with respect to each other, one in left-handed design and one in right-handed design.

* * * * *

UNITED STATES PATENT AND TRADEMARK OFFICE

CERTIFICATE OF CORRECTION

PATENT NO. : 6,887,410 B2
DATED : May 3, 2005
INVENTOR(S) : Kress et al.

It is certified that error appears in the above-identified patent and that said Letters Patent is hereby corrected as shown below:

Column 4,
Line 52, "production or threads" should read -- production of threads --.

Column 5,
Line 33, "thread supply guides (6)" should read -- thread supply guides (5) --.

Signed and Sealed this

Fourteenth Day of February, 2006

JON W. DUDAS
*Director of the United States Patent and Trademark Office*